United States Patent [19]

Lee

[11] 4,291,110

[45] Sep. 22, 1981

[54] SILOXANE HOLE TRAPPING LAYER FOR OVERCOATED PHOTORECEPTORS

[75] Inventor: Lieng-Huang Lee, Webster, N.Y.

[73] Assignee: Xerox Corporation, Stamford, Conn.

[21] Appl. No.: 47,461

[22] Filed: Jun. 11, 1979

[51] Int. Cl.[3] ..... G03G 5/14; G03G 5/10

[52] U.S. Cl. ..... 430/59; 430/58; 430/60; 430/66; 430/903; 430/63

[58] Field of Search ..... 430/59, 66, 67

[56] References Cited

U.S. PATENT DOCUMENTS

| | | | |
|---|---|---|---|
| 3,041,167 | 6/1962 | Blakney et al. | 430/125 |
| 3,869,285 | 3/1975 | Kondo et al. | 430/49 |
| 3,953,207 | 4/1976 | Horgan | 430/58 |
| 4,071,363 | 1/1978 | Jones | 430/130 |
| 4,123,269 | 10/1978 | Von Hoene et al. | 430/60 |
| 4,152,152 | 5/1979 | Contois | 430/79 |

*Primary Examiner*—Roland E. Martin, Jr.
*Assistant Examiner*—John L. Goodrow
*Attorney, Agent, or Firm*—E. O. Palazzo

[57] ABSTRACT

Disclosed is a novel hole trapping layer and the use of this layer in an overcoated photoresponsive device, this hole trapping layer being comprised of materials of the following formulas:

I.

II.

III.

IV.

V.

wherein $R^1$, $R^2$, $R^3$, $R^4$, $R^5$, and $R^6$ which may be the same or different radicals, are selected from aliphatic, substituted aliphatic, aromatic, and substituted aromatic, the substituents including for example alkyl, halogen and the like, x and y are numbers from 2 to about 10 and preferably from 2 to about 4, m and n are numbers of from 1 to 3, the sum of m and n being equal to 4, and Z is a sulfonyl ($—SO_2$) or a carboxyl ($—CO_2$) radical. Examples of aliphatic radicals include alkyl of from 1 to about 20 carbon atoms such as methane, ethane, propane, butane, isobutane, pentane, neopentane, heptane, decane, tetradecane, eicosane, and the like. Illustrative examples of aromatic radicals include those containing from about 6 to about 20 carbon atoms such as phenyl, naphthyl, anthryl and the like.

8 Claims, 5 Drawing Figures

SILOXANE HOLE TRAPPING LAYER FOR OVERCOATED PHOTORECEPTORS

This invention is directed generally to an electrophotographic imaging device and more specifically a device which contains certain trapping layers as well as a method of imaging utilizing this device.

The formation and development of images on the imaging surfaces of photoconductive materials by electrostatic means such as xerography is well known. Numerous different types of photoreceptors can be used in the xerographic process including inorganic materials, organic materials, and mixtures thereof. Photoreceptors are known which include an overcoating layer of an electrically insulating polymeric material and in conjunction with this overcoated type photoreceptor there have been proposed a number of imaging methods. The art of electrophotography and more specifically xerography continues to advance and different as well as more stringent types of demands need to be met by the copying apparatus in order to increase performance standards so that higher quality images can be obtained. There continues to be a need for a protectant overcoating for the photoreceptor and also a desire to control the manner and type of charges that are transported and retained at various levels of the photoreceptor device.

A method for utilizing an overcoated photoreceptor device is described in copending application U.S. Ser. No. 881,262, filed 2/24/78 now abandoned on Electrophotographic Imaging Methods, Simpei Tutihasi inventor, the specification, examples, and drawings of such application being totally incorporated herein by reference. In summary the method as described in this application utilizes an imaging member comprised of a substrate, a layer of charge carrier injecting electrode material, a layer of charge carrier transport material, a layer of a photoconductive charge carrier generating material and an electrically insulating overcoating layer. In one of the embodiments the method of operation is accomplished by charging the overcoated photoreceptor device a first time with electrostatic charges of a first polarity, followed by charging a second time with electrostatic charges of a polarity opposite to that of the first polarity in order to substantially neutralize the charges residing on the electrically insulating surface of the member followed by exposure of the device to an imagewise pattern of activating electromagnetic radiation whereby an electrostatic latent image is formed which image may be subsequently developed and transferred to a receiving member. The actual operation of this member is best illustrated by referring to the Figures which are a part of the application and more specifically FIGS. 2A-2C.

A hole trapping layer material which is discussed in greater detail hereinafter is between the generating layer and the insulating layer, and is of importance since if the holes, that is positive charges are not substantially retained at the interface between the two above mentioned layers the efficiency of the photoreceptor is adversely affected when such holes are allowed to freely migrate back to the generator layer. If some of the holes are allowed to migrate they will travel toward the electrode layer and neutralize the negative charges located between the hole injecting layer 14 and the transport layer 16 thus reducing the overall voltage useful for the succeeding imaging process. This could adversely affect the imaging system as well as lower the efficiency of such a device and render the cyclic characteristics unstable. The trapping layer will assure that substantially all holes remain at the interface.

OBJECTS OF THE PRESENT INVENTION

It is an object of this invention to provide a photoreceptor device which overcomes the above noted disadvantages.

A further object of this invention is to provide an improved organic photoreceptor device containing a trapping layer.

Yet another object of this invention is the provision of a method for the preparation of the trapping layer to be used in the overcoated photoreceptor device.

Another object of this invention is providing a trapping layer which prevents charges from migrating from the interface between the generating layer and the overcoating insulating layer to the injecting electrode in order to improve image quality, reduce dark decay, and improve cyclability of the photoreceptor device.

These and other objects of the present invention are accomplished by providing a hole trapping layer comprised of nitrogen containing siloxanes or nitrogen containing titanium compounds and mixtures thereof, these materials being of the following general formulas:

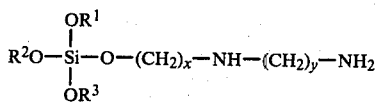

I.

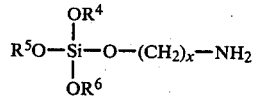

II.

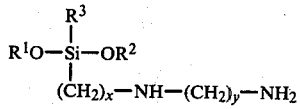

III.

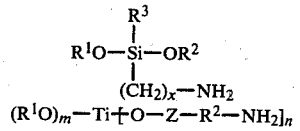

IV.

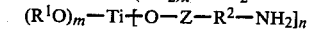

V.

wherein $R^1$, $R^2$, $R^3$, $R^4$, $R^5$, and $R^6$ which may be the same or different radicals, are selected from aliphatic, substituted aliphatic, aromatic, and substituted aromatic, the substituents including for example alkyl, halogen and the like, x and y are numbers from 2 to about 10 and preferably from 2 to about 4, m and n are numbers of from 1 to 3, the sum of m and n being equal to 4, and Z is a sulfonyl ($—SO_2$) or a carboxyl ($+CO_2$) radical. Examples of aliphatic radicals include alkyl of from 1 to about 20 carbon atoms such as methane, ethane, propane, butane, isobutane, pentane, neopentane, heptane, decane, tetradecane, eicosane, and the like. Illustrative examples of aromatic radicals include those containing from about 6 to about 20 carbon atoms such as phenyl, naphthyl, anthryl and the like.

In one embodiment the aromatic substituted materials are of the following formula:

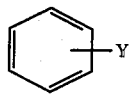

wherein Y is an aliphatic radical or halogen such as chloride, bromide, iodide and the like.

Illustrative examples of specific materials which may be used as the trapping layer of the present invention, it being noted that these examples are not all inclusive, and other similar or equivalent materials can be used include trimethoxysilyl propylene diamine, hydrolyzed trimethoxy silyl propyl ethylene diamine, N-$\beta$-(aminoethyl)-gama-amino-propyl trimethoxy silane, isopropyl, 4-aminobenzene sulfonyl, di(dodecylbenzene sulfonyl) titanate, isopropyl di(4-aminobenzoyl) isostearoyl titanate, isopropyl, tri(N-ethylamino-ethylamino) titanate, isopropyl, trianthranil titanate, isopropyl, tri(N,N-dimethyl-ethylamino) titanate, titanium-4-amino benzene sulfonate, dodecyl benzene sulfonate oxyacetate, titanium 4-aminobenzoate isostearate oxyacetate, $[H_2N(CH_2)_4]CH_3Si(OC_2H_5)_2$, (gamma-aminobutyl) methyl diethoxysilane, $[H_2N(CH_2)_3]CH_3Si(OCH_3)_2$ (gamma-aminopropyl) methyl dimethoxysilane, other corresponding alkyl, aromatic, substituted alkyl, and substituted aromatic materials; and the like.

In one preferred embodiment, the hole trapping materials are incorporated into a layer comprised of adhesive polymers. The trapping layer of the photoresponsive device is of substantial importance as mentioned hereinbefore, its main function being to trap holes, that is, positive charges, thus the material used in this layer must be capable of emitting electrons in order that the positive charges will be trapped, that is, remain in position at the interface between the generating layer and the overcoating insulating layer. The photoresponsive device may remain photosensitive without the trapping layer, however, higher fields will be needed in order to render the device efficient, the disadvantage of using higher fields being that it causes breakdown in the system and more ozone is generated thus posing an environmental problem in some situations. It is preferable to use lower voltages as the system is more efficient and more stable and further with the hole trapping layer, the dark decay of the system, that is leakage of charges, will improve significantly so as to substantially eliminate such dark decay.

Generally, the hole trapping layer which is designated by the numeral 21 in FIG. 1, in one preferred embodiment, is prepared by coating this layer on the surface of the generating layer 18 followed by application of a laminated material containing an adhesive layer and an insulating overcoat layer such as Mylar. In another embodiment that is where the trapping layer is not a discrete layer but is combined with the adhesive materials, designated by 19 in FIG. 1A, the trapping molecules are dispersed in an adhesive polymer and this layer is then applied to the insulating film. In this way the hole trapping layer can be effectively adhered to the generating layer by lamination.

The thickness of the hole trapping layer can range over a wide spectrum and also depends on the manner in which the hole trapping layer is applied. For example, when a lamination process is used, and the hole trapping layer is coated on the generating layer, the thickness of the hole trapping layer ranges from about 0.005 to 1 micron and preferably from about 0.05 to 0.2 microns, while when the hole trapping layer is incorporated into an adhesive material, the trapping layer ranges in thickness from about 1 to 15 microns and preferably from 3 to about 8 microns. The thickness of the adhesive layer when it is employed as a separate layer and is not part of the hole trapping layer for example see FIG. 1, layer 22, ranges from about 1 to about 15 microns and preferably from about 3 to about 8 microns.

In one preferred embodiment of the present invention, the photoresponsive device is comprised of a hole trapping layer 21 sandwiched in between a generator layer 18, an adhesive layer 22 and/or an overcoating insulating layer 20, the remaining portions of the photoreceptor device being comprised of a substrate, a hole injecting electrode layer thereover comprised of carbon black dispersed in a polymer, a charge transport layer comprised of an electrically inactive organic polymer having dispersed therein an electrically active material, the combination of which is substantially nonabsorbing to visible electromagnetic radiation but allows the injection of photogenerated holes from a charge generating layer in contact with the hole transport layer which layer is overcoated with the charge generating material 18 previously described.

BRIEF DESCRIPTION OF THE DRAWINGS

For a better understanding of the present invention and further features thereof, reference is made to the following detailed description of various preferred embodiments wherein.

DESCRIPTION OF THE PREFERRED EMBODIMENTS

Figure 1:
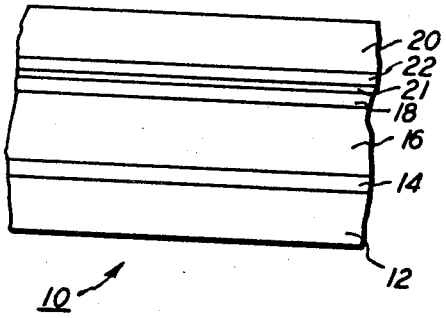
FIGS. 1 and 1A are partially schematic cross-sectional views of a photoreceptor device containing a trapping layer which may be utilized in the method of the present invention.
Figure 1A:
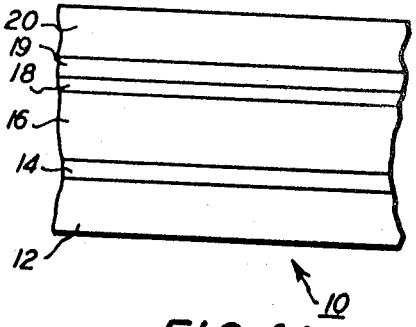

Illustrated in FIG. 1 is a photoreceptor generally designated 10 comprising a substrate 12, a layer of charge injecting electrode material 14, a layer of charge carrier transport material 16, a layer of photoconductive charge carrier generating material 18, a layer of trapping material 21, a layer of adhesive material 22, and a layer of electrically insulating polymeric material 20, it being noted that the layer of adhesive material 22 can be coated on the electrically insulating polymeric material in one embodiment. FIG. 1A illustrates a similar type of photoreceptor with the exception that the layer of trapping material is represented by 19, this layer being comprised of a combination of trapping and adhesive materials. Substrate 12 may be opaque or substantially transparent and may comprise any suitable material having the requisite mechanical properties. The substrate may comprise a layer of non-conducting material such as an inorganic or organic polymeric material; a layer of an organic or inorganic material having a conductive surface layer arranged thereon or a conductive material such as, for example, aluminum, brass or the like. The substrate may be flexible or rigid and may have any of many different configurations such as, for example, a plate, a cylindrical drum, a scroll, an endless flexible belt, and the like. Preferably, the substrate is in the form of an endless flexible belt.

The thickness of this layer can vary but generally is from about 3 to 100 mils and preferably from about 3 to 10 mils although thickness of over 100 mils and less than 3 mils can be used.

Charge carrier injecting electrode layer 14 must be capable of injecting charge carriers or holes into the transport layer 16 under the influence of an electrical field. The charge carrier injecting electrode layer may be sufficiently laterally conductive to also function as the ground electrode for the photoreceptor and in such a situation a separate additional conductive layer is not necessary.

Numerous materials can be used as the charge injecting electrode layer including those materials (such as for example, gold, graphite, carbon black or graphite dispersed in various polymer resins and the like) which effectively inject holes that is positive charges into the transport layer. These materials are capable of injecting holes under the influence of an electrical field. In a preferred embodiment, carbon black or graphite dispersed in various polymers is used as the injecting electrode, this charge injecting electrode being prepared as described in copending U.S. Ser. No. 905,250, filed 5/12/78, J. Y. C. Chu and S. Tutihasi inventors, which in one method involves solution casting of a mixture of carbon black or graphite dispersed in an adhesive polymer solution onto a support substrate such as Mylar or aluminized Mylar. The hole injecting electrode which is preferably carbon black or graphite dispersed in a polymer also functions as a permanent adhesive between the substrate and the organic transport layer. Thus, the injecting layer does not have a tendency to peel off, that is to be separated from the transport and support layer so that the quality of the image is not adversely effected after repetitive useage. Gold, silver and other such materials when used as the injecting electrode, perform satisfactorily, however, they do not adhere as well as carbon or graphite dispersed in a polymer. One other advantage of using carbon black and graphite in polymers are that these materials are rather inexpensive when compared to gold, for example, are more readily available and function in some instances more effectively than gold.

Illustrative examples of polymers that can be used as the material within which the carbon black or graphite is dispersed include, for example, polyesters such as PE-100 commercially available from Goodyear Chemical Company. Other polyester materials that are useful include those materials classified as polymeric esterification products of a dicarboxylic acid and a diol comprising a diphenol. Typical diphenols include 2,2-bis(4-beta hydroxy ethoxy phenyl)-propane, 2,2-bis(4-hydroxy isopropoxy phenyl)propane, 2,2-bis(4-beta hydroxy ethoxy phenyl)pentane, 2,2-bis(4-beta hydroxy ethoxy phenyl) butane and the like, while typical dicarboxylic acids include oxalic acid, malonic acid, succinic acid, adipic acid, phthalic acid, terephthalic acid, maleic acid, fumaric acid and the like. Any polyester or other polymeric materials may be used providing they do not adversely affect the system and allow a uniform dispersion of the carbon black or graphite therein.

The hole injecting layer has a thickness in the range of from about 1 to about 20 microns or more with the preferred range being from about 4 microns to about 10 microns. The maximum thickness is generally determined by the mechanical properties desired. The charge carrier injecting materials and charge carrier transport materials require a particular work function relationship in order that hole injection from the former into the latter can be effectively accomplished. Normally the hole injecting materials have a relatively high work function.

The ratio of polymer to carbon black or graphite ranges from about 0.5 to 1 to 2 to 1 with a preferred ratio of about 6 to 5.

The charge carrier transport layer 16 can be any number of numerous suitable materials which are capable of transporting holes, this layer generally having a thickness in the range of from about 5 to about 50 microns and preferably from about 20 to about 40 microns. In a preferred embodiment this transport layer comprises molecules of the formula: (⊖ represents phenyl)

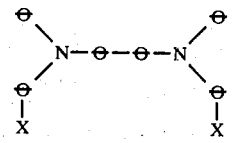

dispersed in a highly insulating and transparent organic polymeric material wherein X is selected from the group consisting of (ortho) $CH_3$, (meta) $CH_3$, (para) $CH_3$, (ortho) Cl, (meta) Cl, (para) Cl. This charge transport layer, which is described in detail in copending application Ser. No. 716,403 (series of 1970) filed by Milan Stolka et al on Aug. 23, 1976, and totally incorporated herein by reference, is substantially non-absorbing in the spectral region of intended use, i.e., visible light, but is "active" in that it allows injection of photogenerated holes from the charge generator layer and electrically induced holes from the injecting electrode. The highly insulating polymer, which has a resistivity of at least $10^{12}$ ohm-cm to prevent undue dark decay, is a material which is not necessarily capable of supporting the injection of holes from the injecting or generator layer and is not capable of allowing the transport of these holes through the material. However, the polymer becomes electrically active when it contains from about 10 to 75 weight percent of the substituted N,N,N',N'-tetraphenyl-[1,1'-biphenyl]4-4'-diamines corresponding to the foregoing formula. Compounds corresponding to this formula include, for example, N,N'-diphenyl-N,N'-bis(alkyl-phenyl)-[1,1-biphenyl]-4,4-diamine wherein alkyl is selected from the group consisting of methyl such as 2-methyl, 3-methyl and 4-methyl, ethyl, propyl, butyl, hexyl and the like. In the case of chloro substitution, the compound is named N,N'-diphenyl-N,N'-bis(-halo phenyl)-[1,1'-biphenyl]-4,4'-diamine wherein the halogen atom is 2-chloro, 3-chloro or 4-chloro.

Other electrically active small molecules which can be dispersed in the electrically inactive polymer to form a layer which will transport holes include triphenylmethane, bis-(4-diethylamino-2-methylphenyl) phenylmethane; 4',4''-bis(diethylamino)-2,2''-dimethyltriphenyl methane; bis-4(-diethylamino phenyl) phenylmethane; and 4,4'-bis(diethylamino)-2,2'-dimethyltriphenylmethane.

Transport layer 16 may comprise any electrically inactive binder polymeric material such as those described by Middleton et al., in U.S. Pat. No. 3,121,006, incorporated herein by reference. The polymeric binder contains from 10 to 75 weight percent of the active material corresponding to the foregoing formula and preferably from about 35 to about 50 weight percent of this material. Typical organic polymeric materials useful as the binder include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binder materials are polycarbonates having a molecular weight ($M_w$) of from about 20,000 to about 100,000 with a molecular weight in the range of from about 50,000 to about 100,000 being particularly preferred.

Photoconductive charge carrier generating layer 18 generally may comprise any photoconductive charge carrier generating material known for use in electrophotography provided it is electronically compatible with the charge carrier transport layer and the charge carriers can travel in both directions across the interface between the two layers. Particularly preferred photoconductive charge carrier generating materials include materials such as phthalocyanines like metal free, for example, the X-form of phthalocyanine, or metal phthalocyanines including vanadyl phthalocyanine. These materials can be used alone or as a dispersion in a polymeric binder. Layer 18 is typically from about 0.5 to about 10 microns or more in thickness. Generally, it is desired to provide this layer in a thickness which is sufficient to absorb at least 90 percent (or more) of the incident radiation which is directed upon it in the imagewise exposure step.

Electrically insulating overcoating layer 20 typically has a bulk resistivity of from about $10^{12}$ to about $5\times10^{14}$ ohm-cm and typically is from about 5 to about 25 microns in thickness. Generally, this layer provides a protective function in that the charge carrier generating layer is kept from being contacted by toner and ozone which is generated during the imaging cycles. The overcoating layer also must prevent charges from penetrating through it into charge carrier generating layer 18 or from being injected into it by the latter. Preferably, therefore, layer 20 comprises materials having higher bulk resistivities. Generally, the minimum thickness of the layer in any instance is determined by the functions the layer must provide whereas the maximum thickness is determined by mechanical considerations and the resolution capability desired for the photoreceptor. Typical suitable materials include Mylar (a polyethylene terephthalate film commercially available from E. I. duPont de Nemours), polyethylenes, polycarbonates, polystyrenes, polyesters, polyurethanes and the like. The particular material selected in any instance should not be one which will dissolve or react with the materials used in layers 16 and 18.

The formation of the electrically insulating layer 20 over the previous layer may be carried out by lamination or solution coating; where layer 20 constitutes a preformed mechanically tough film, it is typically necessary to provide sufficient adhesive material in order to provide an integral structure which is desirable for use in a repetitive imaging method. The electrical properties of any such adhesive interlayer should be similar to those of the overcoating. Alternatively, they may be similar to the binder material of the charge carrier generating layer 18 where a binder material is present in that layer. Mechanically, the adhesive interlayer should provide an adhesive state that firmly binds the layers together without any air gaps or the like which could disturb image definition.

Figure 2A:
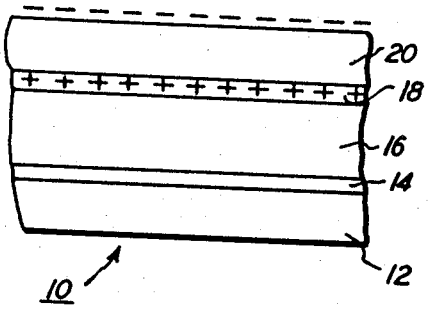
FIGS. 2A to 2C illustrate the various method steps employed.

The charge carrier injecting electrode material which comprises layer 14 is a hole injecting material such as graphite, gold, and carbon or graphite dispersed in a polymer and the initial charging step is carried out with negative polarity. More specifically, there is represented in FIG. 2A the condition of the photoreceptor after it has been electrically charged negatively a first time in the absence of illumination by any suitable electrostatic charging apparatus such as a corotron. The negative charges reside on the surface of electrically insulating layer 20. As a consequence of the charging, an electrical field is established across the photoreceptor and as a consequence of the electrical field, holes are injected from the charge carrier injecting electrode layer into the charge carrier transport layer. The holes injected into the charge carrier transport layer are transported through the layer, enter into the charge carrier generating layer 18 and travel through the latter until they reach the interface between the charge carrier generating layer 18 and the hole trapping layer where they become trapped. The charges are thus substantially trapped at the interface, and establish an electrical field across the electrically insulating layer 20, therefore, where negative charging is carried out in the first charging step, charge carrier injecting layer 14 and charge carrier transport layer 16 must comprise materials which will allow injection of holes from the former into the latter and charge transport layer 16 comprises materials which will predominantly transport holes. The charge carrier transport layer 16 and the charge carrier generating layer 18 must comprise materials which will allow injection of holes from the former into the latter and allow the holes to travel to the interface between layer 18 and hole trapping layer 19 or 21. Generally, the electrical field established by the first charging is in the range of from 10 volts/micron to about 100 volts/micron.

Subsequently, the member is charged a second time in the absence of illumination with a polarity opposite to that employed in the first charging step for the purpose of substantially neutralizing the charges residing on the surface of the member. The second charging of the member in this embodiment is effected with positive polarity. Subsequent to the second charging step, the surface of the photoreceptor should be substantially free of electrical charges. The substantially neutralized surface is created by selecting a charging voltage based on the dielectric thickness ratio of the overcoating layer 20, plus the hole trapping layer 19, or 21 and 22 to the total of the charge carrier transport and charge carrier generating layers 16 and 18 respectively. By substantially neutralized is meant that the voltage across the photoreceptor member upon illumination of the photoreceptor may be brought to substantially zero.

Figure 2B:
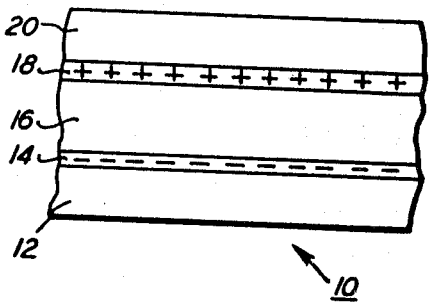

In FIG. 2B, there is illustrated the condition of the photoreceptor after the second charging step, wherein no charges are shown on the surface of the member. The positive charges residing at the interface of layers 18 and 19 in FIG. 1A or layers 18 and 21 in FIG. 1 as a result of the first charging step remain substantially trapped at that interface at the conclusion of the second charging step. However, there is now a uniform layer of negative charges located at the interface between layers 14 and 16. The net result of the second charging step is to establish a uniform electrical field across the charge carrier transport and charge carrier generating layers. In order to obtain this result, it is important that the negative charges be located at the interface between the charge carrier injecting layer 14 and charge carrier transport layer 16 and prevented from entering into the transport layer. For this reason, it is preferred to utilize a charge carrier transport material which will transport only one species of charge carrier, holes in this situation. Where a charge carrier transport material capable of transporting both species of charge carriers is employed, in layer 16, the charge carrier injecting material would have to be selective so that the latter would be unable to inject electrons into layer 16 thus placing constraints on the selections of materials.

Figure 2C:
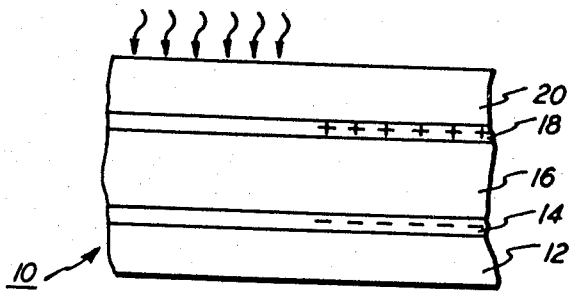

The member is then exposed to an imagewise pattern of electromagnetic radiation (FIG. 2C) to which the charge carrier generating material comprising layer 18 is responsive. Exposure of this member is accomplished through the electrically insulating overcoating. As a result of the imagewise exposure an electrostatic latent image is formed in the photoreceptor as the hole electron pairs are generated in the light struck areas of the charge carrier generating layer. The light generated holes are injected into the charge carrier transport layer and travel through it to be neutralized by the negative charges located at the interface between layers 14 and 16 whereas the light generated electrons neutralize the positive charges trapped at the interface between layers 18 and 19 or 21. In the areas of the member which did not receive any illumination, the positive charges remain in their original position, thus there continues to be an electrical field across the charge carrier transport and charge carrier generating layers in the areas which do not receive any illumination whereas the electrical field across the same layers in the areas which did receive illumination is discharged to some low level.

The electrostatic latent image formed in the member may be developed to form a visible image by any of the well known xerographic development techniques, for example, cascade, magnetic brush, liquid development and the like. The visible image is typically transferred to a receiver member by any conventional transfer technique and affixed thereto. While it is preferably to develop the electrostatic latent image with marking material the image may be used in a host of other ways such as, for example, "reading" the latent image with an electrostatic scanning system.

When the photoreceptor is to be reused to make additional reproductions as is the case in a recyclible xerographic apparatus any residual charge remaining on the photoreceptor after the visible image has been transferred to a receiver member typically is removed therefrom prior to each repetition of the cycle as is any residual toner material remaining after the transfer step. Generally, the residual charge can be removed from the photoreceptor by ionizing the air above the electrically insulating overcoating of the photoreceptor while the photoconductive carrier generating layer is uniformly illuminated and grounded. For example, charge removal can be effected by A.C. corona discharge in the presence of illumination from a light source or preferably a grounded conductive brush could be brought into contact with the surface of the photoreceptor in the presence of such illumination. This latter mode also will remove any residual toner particles remaining on the surface of the photoreceptor.

Examples of adhesive materials layer 22 or as part of layer 19 include polyesters such as those commercially available from E. I. duPont Co. (i.e. duPont Polyester 49000), polyurethanes and the like).

Other advantages of using the hole trapping layer of the present invention, in addition to those mentioned, applicable especially to the hydrolyzed silane system include (1) non-migration of the layer—the hydrolyzed silane is insoluble in the polyesters or polyurethanes, thus the trapping layer is permanently attached at the interface; (2) other small molecules can diffuse through the adhesive layer into the photogenerator layer, therefore the charging characteristics of the photoreceptor is damaged; (3) the hydrolyzed silane acts as an adhesive promoter, or a coupling agent. After the silane is hydrolyzed it forms polysiloxanes with reactive amino groups.

The invention will now be described in detail with respect to specific preferred embodiments thereof, it being understood that these Examples are intended to be illustrative only and the invention is not intended to be limited to the materials, conditions, process parameters, etc., recited herein. All parts and percentages are by weight unless otherwise indicated.

EXAMPLE I

A photoreceptor was fabricated using an approximately 5 mil thick Mylar substrate. A charge injecting composition was formed thereover by preparing a 12 percent solution of PE-100 polyester resin commercially available from Goodyear Chemical in chloroform, adding to it approximately about 10 percent by weight of carbon black and ball-milling the mixture for about 24 hours with steel shot. Approximately 4–6 micron thick layer of the composition was deposited on the Mylar substrate and the sample was dried to remove residual solvents. An approximately 25 micron thick charge carrier transport layer of N,N'diphenyl-N,N'bis(3 methyl phenyl) [1,1'biphenyl]4,4'diamine in a polycarbonate binder (1:1 ratio) was formed on the carbon black layer by solvent cooling from a methylene chloride solution using a draw bar coating technique. The member was dried in a vacuum oven at a temperature of about 70° C. for about 24 hours.

A charge carrier generating layer comprised of a dispersion of 5 percent DuPont 49000 polyester and 2.3 percent of x-metal free phthalocyanine and methylene chloride was then subsequently applied as an overcoat to the transport layer followed by drying. Trimethoxysilyl propylene diamine $[H_2N(CH_2)_2NH(CH_2)_3Si(OCH_3)_3]$ was then dissolved in methanol to form a 1 percent solution (by weight). To this solution, two drops of acetic acid was added to catalyze the hydrolysis of the silane solution. The solution was then coated on Mylar by a draw bar applicator. The coating was achieved by using 0.5 and 2.0 mil multiple gap applicators. The coated plate was dried in a vacuum oven overnight at 50° C.

After drying the coated Mylar (0.5 mil.) was laminated to the generator layer using duPont Polyester 46923 and Chemolk B-2567-4 polyurethane respectively. The Chemlok polyurethane adhesive was in methyl ethyl ketone as a 30 percent solution. The adhesive solution was then diluted to 10 percent with the same solvent, and solution coated onto 0.5 mil Mylar film with a 1.0 mil Bird film applicator and dried for four hours in a vacuum oven at 60° C. to produce a dry coating of oil mil thickness.

The duPont polyester 46923 was dissolved in a dioxane/toluene mixture (1:1) and diluted to 10 percent solution. The lamination was carried out at 167° C. with the laminator roll speed of 1.2 cm/sec. Electrical measurements of the laminated photoreceptors are described in terms of the dark decay in volt/second and the positive to negative charge ratio as shown in Table 1.

TABLE 1

Dark Decay and Charge Ratios of Flexible Photoreceptors Containing Silane Trapping Agent (Measurements were carried out at low field −400 v to −800 v on photoreceptor).

| | Coating Thickness (Wet) | Dark Decay Volts/Sec. | Charge Ratio (Pos - Neg) |
|---|---|---|---|
| Control | | | |
| DuPont 46923 Polyester | 0.5 mil | | |
| Chemlok B-2567-4 | 2.0 mil | 68.0 | 0.25:1 |
| Polyurethane | 0.5 mil | | |
| Non-Hydrolyzed Silane | 2.0 mil | 28.0 | 0.44:1 |
| $(RO-\overset{\vert}{\underset{\vert}{Si}}-OR)$ | | | |
| DuPont | 0.5 mil | Photoreceptor did not function properly | |
| 46923 Polyester | 2.0 mil | 20.0 | 0.20:1 |
| Chemlok B-2567-4 | 0.5 mil | Photoreceptor did not function properly | |
| Polyurethane | 2.0 mil | Photoreceptor did not function properly | |
| Hydrolyzed Silane | | | |
| DuPont | 0.5 mil | 29.0 | 0.29:1 |
| 46923 Polyester | 2.0 mil | 32.0 | 0.18:1 |
| Chemlok B-2567-4 | 0.5 mil | 34.0 | 1.78:1 |
| Polyurethane | 2.0 mil | 25.0 | 2.05:1 |

The above results show that it is the hydrolyzed silane which gives high positive to negative charge ratios especially in the case of polyurethane resin as an adhesive for the photoreceptor. After hydrolysis the silane is converted into polysiloxane forming an attached layer at the interface.

When the hole trapping layer of this example was used in the photoreceptor device excellent cyclic stability was obtained thus allowing the production of continuous images of high quality in commercial copying machine in excess of 5,000 copies. Therefore images of high quality could be obtained no cyclability being needed and no waiting period as compared with low quality images and a waiting period when the hole trapping layer is not employed.

EXAMPLE II

The procedure of Example I is repeated with the exception that the hydrolyzed gamma-amino-propyl triethoxysilane $[H_2N(CH_2)_3Si(OC_2H_5)_3]$ was used in place of the trimethoxysilyl propylene diamine. Excellent charge ratio was obtained with polyurethane as an adhesive, and substantially similar imaging results obtained when the material of this Example was used in a photoreceptor device.

EXAMPLE III

The procedure of Example I is repeated with the exception that the hydrolyzed triethoxy silyl propylene diamine $H_2N(CH_2)_2NH(CH_2)_3Si(OC_2H_5)_3$ was used in place of trimethoxysilyl propylene diamine. Excellent charge ratio was obtained with polyurethane as an adhesive.

EXAMPLE IV

The procedure of Example I is repeated with the exception that the hydrolyzed gamma-amino propyl trimethoxy silane $[H_2N(CH_2)_3Si(OCH_2)_3]$ was used. Excellent charge ratio was obtained with polyurethane as an adhesive.

EXAMPLE V

The procedure of Example I was repeated with the exception that 4-aminobenzene sulfonyl di(dodecyl benzene sulfonyl) titanate was used in place of trimethoxysilyl propylene diamine. Excellent charge ratio, good copy quality resulted when a photoreceptor containing this material as a hole trapping layer was used in a commercial copying machine.

EXAMPLE VI

The procedure of Example III was repeated with the exception that a polyester material, E. I. duPont 49000 was used in place of a polyurethane adhesive, and substantially similar results obtained.

Although the invention has been described with respect to specific preferred embodiments it is not intended to be limited thereto, but rather those skilled in the art will recognize that variations and modifications may be made therein which are within the spirit of the invention and the scope of the claims.

What is claimed is:

1. A layered photosensitive imaging member which comprises from the bottom up (a) a support substrate; (b) a layer of electrode material capable of injecting holes into a layer on its surface, this layer being comprised of materials selected from the group consisting of graphite, carbon, carbon dispersed in a polymer, or gold; (c) a hole transport layer in operative contact with the layer of hole injecting material which transport layer comprises a combination of a highly insulating organic polymer having dispersed therein small molecules of an electrically active material, the combination of which is substantially non-absorbing to visible light but allows injection of photogenerated holes from a charge generator in contact with the hole transport layer, and electrically induced holes from the layer of the injecting electrode material, (d) a layer of photocharge generating material on and in operative contact with the charge transport layer; (e) a hole trapping layer comprised of nitrogen-containing siloxanes or nitrogen-containing titanium compounds of the formulas

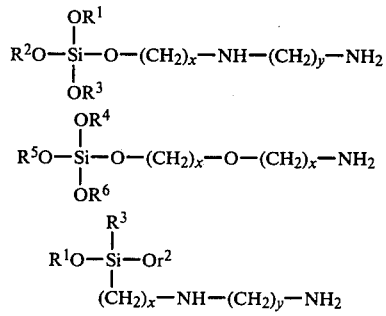

I.

II.

III.

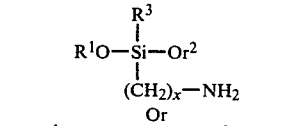

IV.

Or

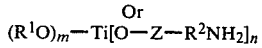

V.

wherein $R^1$, $R^2$, $R^3$, $R^4$, $R^5$, and $R^6$ which may be the same or different radicals, are selected from aliphatic, substituted aliphatic, aromatic, and substituted aromatic, x and y are numbers from 2 to about 10, m and n are numbers of from 1 to 3, the sum of m and n being equal to 4, and Z is sulfonyl ($-SO_2$) or a carboxyl ($-CO_2$) radical, and (f) a layer of insulating organic polymer overlaying the layer of generating material.

2. A layered photosensitive imaging member in accordance with claim 1 wherein $R^1$, $R^2$, $R^3$, $R^4$, and $R^5$ are alkyl radicals of from 1 to about 20 carbon atoms.

3. A layered photosensitive imaging member in accordance with claim 1 wherein the hole trapping material is trimethoxysilyl propylene diamine, hydrolyzed gamma amino propyl triethoxy silane, hydrolyzed triethoxy silyl propylene diamine, or gamma amino propyl trimethoxy silane.

4. An imaging member in accordance with claim 1 wherein the hole trapping layer contains as an additional material an adhesive material.

5. A layered photosensitive imaging member in accordance with claim 4 wherein the adhesive material is a polyester or a polyurethane.

6. An imaging member in accordance with claim 1 wherein the electrically active material dispersed in the insulating organic polymer is a nitrogen containing compound of the formula:

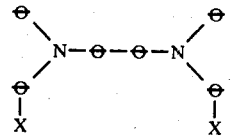

wherein x is selected from the group consisting of (ortho) $CH_3$, (meta) $CH_3$, (para) $CH_3$, (ortho) Cl, (meta) Cl and (para) Cl, and -⊖- is a phenyl radical.

7. An electrophotographic imaging method comprising providing a layered photosensitive imaging member of claim 1 charging the photoreceptor with negative electrostatic charges, followed by charging the photoreceptor with positive electrostatic charges in order to substantially neutralize the negative charge residing on the surface of the photoreceptor and exposing the photoreceptor to an imagewise pattern of electromagnetic radiation to which the charge carrier generating material is responsive whereby there is formed an electrostatic latent image within the photoreceptor.

8. A method in accordance with claim 7 and further including the step of forming a visible image by contacting the surface of the photoreceptor with electroscopic marking materials.

* * * * *